US007373996B1

(12) United States Patent
Martin et al.

(10) Patent No.: US 7,373,996 B1
(45) Date of Patent: May 20, 2008

(54) METHOD AND SYSTEM FOR SEPARATION OF DRILLING/PRODUCTION FLUIDS AND DRILLED EARTHEN SOLIDS

(75) Inventors: Dale R. Martin, Raleigh, IL (US); Perry A. Lopez, Lafayette, LA (US)

(73) Assignee: Centrifugal Services, Inc., Chicago, IL (US)

( * ) Notice: Subject to any disclaimer, the term of this patent is extended or adjusted under 35 U.S.C. 154(b) by 0 days.

(21) Appl. No.: 11/558,969

(22) Filed: Nov. 13, 2006

Related U.S. Application Data

(63) Continuation of application No. 10/321,806, filed on Dec. 17, 2002, now abandoned.

(51) Int. Cl.
*E21B 41/00* (2006.01)

(52) U.S. Cl. ..... 175/206; 175/207; 175/66; 210/787; 210/360.1; 210/512.1; 209/5; 209/233; 209/715; 494/36; 494/53

(58) Field of Classification Search ..... 175/206, 175/207, 66; 210/787, 360.1, 512.1; 209/5, 209/233, 715; 494/53, 36
See application file for complete search history.

(56) References Cited

U.S. PATENT DOCUMENTS 3,688,781 A 9/1972 Talley, Jr.
3,693,733 A * 9/1972 Teague ..... 175/66
3,777,405 A 12/1973 Crawford
3,904,109 A * 9/1975 Underwood ..... 494/36
4,040,866 A 8/1977 Mondshine
4,209,381 A 6/1980 Kelly, Jr.
4,366,063 A 12/1982 O'Connor (Continued)

OTHER PUBLICATIONS

Publication entitled "Water Wash/Oil Wash Cydlonic Column Tank Separation System", Feb. 25, 1992.

(Continued)

*Primary Examiner*—Richard E Chilcot, Jr.
*Assistant Examiner*—Matthew J Smith
(74) *Attorney, Agent, or Firm*—Garvey, Smith, Nehrbass & North, L.L.C.; Gregory C. Smith

(57) ABSTRACT

A method of separating drilling/production fluids from solid cuttings from a mixture received from down hole, without the use of shale shakers, de-sanders, or de-sanders, through the steps of flowing the mixture from the well bore into a flow line above the surface of a well; next, flowing the mixture into a single separation zone of a size capable of receiving the mixture directly from the flow line on a continuous basis; circulating or centrifuging the mixture to a desired RPM within the separation zone; providing a liquid permeable barrier surrounding the mixture as the mixture is centrifuged within the separation zone; collecting the liquid in a first retrieval zone after the liquid has penetrated permeable barrier; and collecting the solids that could not penetrate the permeable barrier in a second retrieval zone within the barrier. The flow into the separation zone may be at a rate of 50-2000 gallons per minute; while the permeable barrier is a screen with openings of a size within the range of 50 to 1500 microns. Also, the mixture is circulated at a rate of a range of 15 to 1200 RPM's in order to achieve separation to a suitable degree. The separation zone would include either a horizontal or vertical centrifuge apparatus.

15 Claims, 9 Drawing Sheets

U.S. PATENT DOCUMENTS

| | | | |
|---|---|---|---|
| 4,387,514 | A | 6/1983 | McCaskill, Jr. |
| 4,546,783 | A | 10/1985 | Lott |
| 4,595,422 | A | 6/1986 | Hill et al. |
| 4,645,608 | A | 2/1987 | Rayborn |
| 4,683,963 | A | 8/1987 | Skinner |
| 4,809,791 | A | 3/1989 | Hayatdavoudi |
| 4,836,302 | A | 6/1989 | Heilhecker et al. |
| 4,961,722 | A | 10/1990 | Taylor et al. |
| 5,090,498 | A | 2/1992 | Hamill |
| 5,303,786 | A | 4/1994 | Prestridge et al. |
| 5,321,898 | A | 6/1994 | Robinette, Jr. et al. |
| 5,405,223 | A | 4/1995 | Sirevag |
| 5,839,521 | A | 11/1998 | Dietzen |
| 6,110,367 | A | 8/2000 | Jensen et al. |
| 6,170,580 | B1 | 1/2001 | Reddoch |
| 6,193,076 | B1 * | 2/2001 | Hensley ..... 210/360.1 |
| 6,553,901 | B2 * | 4/2003 | Reddoch ..... 175/66 |
| 6,665,636 | B1 * | 12/2003 | Allouche et al. ..... 175/206 |

OTHER PUBLICATIONS

Society of Petroleum Engineers (SPE66535) entitled "Reduction of Synthetic Based Fluid Discharges Offshore by the Use of Vertical Basket Centifuges", Copyright 2001, Society of Petroleum Engineers Inc.

Centrifugal Services, Inc. brochure entitled "The Results are Clear".

* cited by examiner

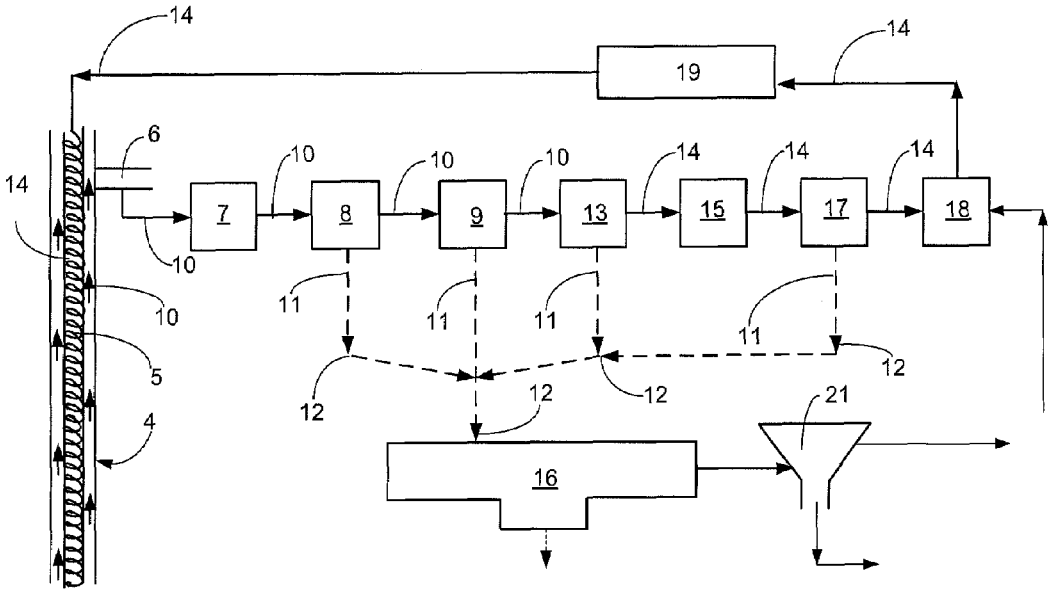
FIG. IB
PRIOR ART

METHOD AND SYSTEM FOR SEPARATION OF DRILLING/PRODUCTION FLUIDS AND DRILLED EARTHEN SOLIDS

CROSS-REFERENCE TO RELATED APPLICATIONS

This application is a Continuation of Ser. No. 10/321,806 filed Dec. 17, 2002, now abandoned

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the separation of drilling/production fluids and drilled earthen solids drilled cuttings, such as drilled cuttings from downhole. More particularly, the present invention relates to a method of separating drilling/production fluids from the drilled cuttings whereby the drilled cuttings are carried by the drilling/production fluids from the drill bit through the annulus and received at the furthest exit point from the well bore for separation and treatment without having to be pre-conditioned through shale shakers, d-sanders, d-silters or other type treatment.

2. General Background of the Invention

Drilled cuttings are generated during the oil and gas drilling operations as the drill bit cuts the earthen formation and is carried by the drilling fluids to the surface of the well for disposition. Drilling fluids leaving the well bore containing drilled earthen solids (drilled cuttings) require separation from the carrier fluid for continuous re-use of the fluid during the drilling operations. Surface pumps are used to convey the drilling fluids down through the drill string (drill pipe) to maintain formation pressure, aid in the drilling process by adding hydraulic force to the drill bit, as well as prolonging the drill bits useful life span by lubrication of the bit and disbursing heat. Other uses for the drilling fluids would include, but not limited to, maintaining hydrostatic pressure, maintaining a wall cake of the formation surfaces for well bore stability, as well as being used as a medium to convey the drilled cuttings from the well bore to the surface of the well.

In the present state of the art, the manner in which the drilled cuttings are treated after reaching the surface is widely known in oil well drilling and production. Historically, when the drilled cuttings, carried by the drilling fluid reaches the surface of the well, the mixture of drilled cuttings and fluids enter a flow line directly off of the drilling or production string, where the mixture flows. The mixture may encounter a gumbo buster, or the like which is a device for diffusing very large solids from the mixture. Next the cuttings laden fluid is routed to a series of shale shakers, d-sanders and d-silters which enhances the separation of smaller solids further separate the drilled cuttings from the fluids of the mixture. The solids are then collected and discarded into the environment or containerized and returned for disposal, or further treatment before final disposition depending on environmental regulations in a specific area. Depending upon their content, the solids are moved into a decanting centrifuge, where the finer solids are removed from the fluids. If the oil content in the mixture is less than 6.9%, but not limited to, then the solids can be discarded to the environment, (which is a limitation dictated by the EPA,) and the fluids are routed back into the borehole for continued use in the drilling/production operations. This multi-stage process is a very expensive and tedious manner in which to efficiently separate the solids from the fluids. There is a need in the industry to simplify the process by eliminating certain steps and combining the treatment into a single confined treatment area to achieve final separation, and eliminate components in the process.

BRIEF SUMMARY OF THE INVENTION

The method and system of the present invention solves the problems in a straightforward manner. What is provided is a process for separating drilled cuttings from drilling/completion fluids which are returning up a borehole of a drilling or production well, which includes the steps of flowing the mixture into a return flow line at the well surface; initially separating the larger solids from the fluids in the mixture; routing the mixture directly to a separation zone; flowing the mixture into a separator; imparting centrifugal force to the mixture at a pre-determined rpm to allow the mixture to flow outward due to the centrifugal force; providing a screen around the separation zone to allow the fluids to flow through apertures in the screen during the motion, but blocking the flow of solids through the screen; allowing the fluids to flow from the separation zone downward to a fluid flow collection area; allowing the solids to drop from the separation zone into a solids collection area or into the environment; and re-routing the fluids into the drilling/production line, without the mixture having to proceed through shale shakers, d-sanders, d-silters or dryers in the process.

Therefore, it is a principal object of the present invention to provide a process for separating solids from fluids during drilling/production from down a borehole without the use of shale shakers, d-sanders, or d-silters in the process without the use and application of conventional traditional means.

It is a further object of the present invention to provide a primary process for separating solids from fluids during drilling/production coming from down a borehole by routing the downhole mixture to a single separation zone to achieve acceptable levels of fluid/solid separation of the mixture.

It is a further object of the present invention to provide a primary process for treating oil well drilled cuttings which flow to the surface of the well but subjecting the drilled cuttings to a single separation process which is less expensive, less time consuming, and eliminates the need for additional equipment found in the present state of the art.

It is a further object of the present invention to provide a system which allows down hole drilled cuttings to be collected at the surface and directed to a single separation process within a single apparatus, to achieve optimal separation of the mixture components so that the fluids can be returned to the bore hole, and the solids can be disposed of at the surface, or collected and contained for final disposition.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 1A and 1B illustrate a schematic views of the prior art method of separating earthen solids from drilling fluids in drilling/production operations;

DETAILED DESCRIPTION OF THE INVENTION

Prior to a discussion of the process and system of the present invention, reference will first be made to FIGS. 1A and 1B, which illustrates in schematic, the current state of the art in carrying out the method of separating solid cuttings from drilling fluid that has been returned to the surface from down the well bore during drilling/production operations. In the current state of the art, when drilling fluids are being circulated down the well bore during drilling or production operations, the fluid is returned to the surface carrying with it solids in the form of earthen cuttings or the like. Therefore, it is necessary that the solids be removed from the mixture or slurry so that the fluids, which are usually very expensive fluids, can be re-circulated down the well bore.

Figure 1A:
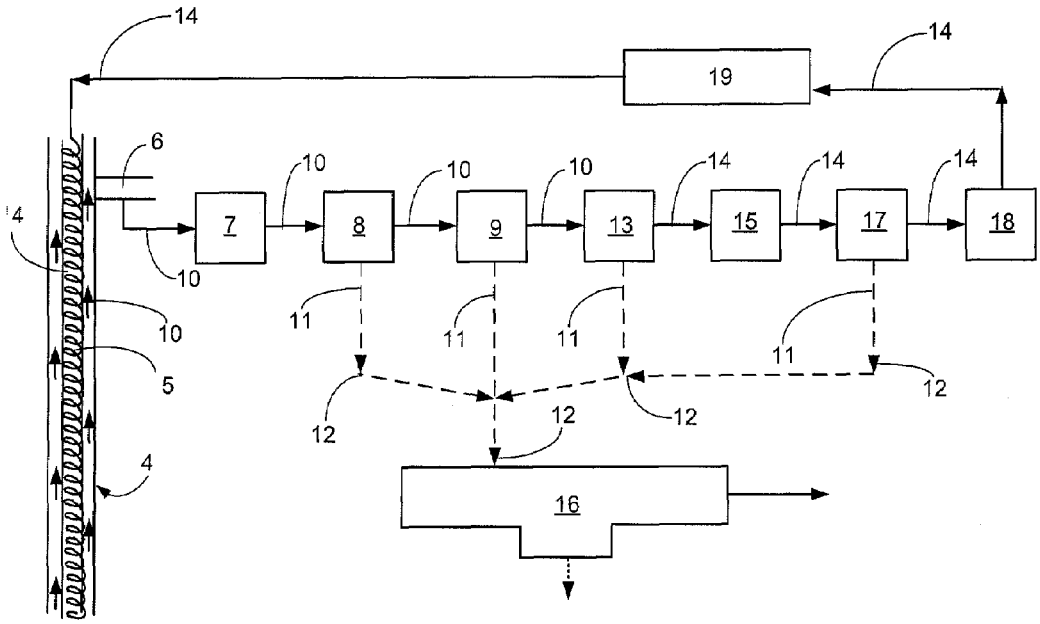
FIG. 1A PRIOR ART

As illustrated first in FIG. 1A, there is represented a wellbore 4 which is typically vertical and/or horizontal but not limited to a inclined bore in which drill or production pipe 5 is set for conducting operations down the wellbore 4 from a surface rig or the like. Upon reaching the surface there is provided a flow line 6 of a certain diameter where the solids/drilling fluid mixture 10 is being returned up the well bore 4 is routed for eventual separation. First, the mixture 10 encounters a gumbo buster or the like 7 which is a device for defusing the very large solids, referred to as gumbo, initially from the mixture 10, so that the mixture may proceed to the further steps in separation. Next, the mixture 10 flows over a series of shakers, as shown a first scalping shaker 8, then a primary shaker 9 which are very common and impart a vibration on the mixture 10 to further sift out solids 11 from the mixture 10. The solids 11 from the shakers 8,9 flow (arrows 12) to a drilled cuttings collection area 16. The mixture is then routed to one or more d-sanders and/or d-silters 13, to remove sand particles from the fluid, and to remove fine particles of silt from the fluid. The solids 11 from the d-sanders and/or d-silters 13 also flow to the drilled cuttings collection area 16. At this point, the fluids component 14 may be routed to a centrifuge 15, which may be a Barite Recovery Centrifuge, of a certain size so as to accommodate essentially fluid with some solid particles, so that the remainder of the solids 11 can be removed. The fluid 14 is then routed to a fines centrifuge (decanter) 17. The cuttings also are routed to the drilled cuttings collection area 16 for collection. The fluid component 14 flows to the rig suction tank 18, then to the rig pump 19, where the fluid 14 is then returned back down the well bore 4. The solids 11, after being separated from the fluids, may be directed from the collection area 16 to the environment, if they are deemed safe for disposal, or, collected for safe disposal.

In a modified method, as seen in FIG. 1B, the method is described in reference to FIG. 1A, but for the fact that rather than the solids 11 being disposed of, the solids 11 are routed to a cuttings dryer 21, for further removal of moisture, and then to disposal. The fluid component 14 flows to the rig suction tank 18, then to the rig pump 19, where the fluid 14 is then returned back down the wellbore 4. This multi-step process may include other permutations, however, the steps as described are usually included in all separation operations and are well known in the art.

Figure 2:
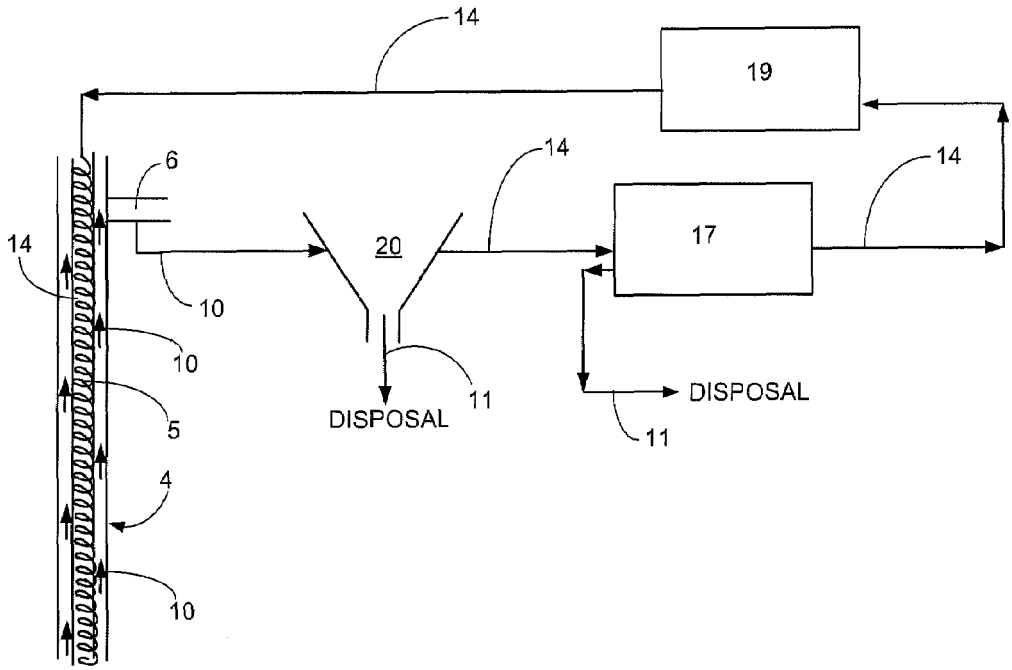
FIG. 2 illustrates a schematic of the process of the present invention in a method of separating solid cuttings from fluid at the surface during oil well drilling/production operations.

FIG. 2 illustrates a broad schematic of the process of the present invention, as will be more defined in reference to FIGS. 3 through 11. Turning first to FIG. 2, the mixture 10 flows from the wellbore 4 into the separation zone 20, which may be defined by either a vertical or horizontal centrifugal separator of the type discussed in reference to FIGS. 3 through 8. From this separation zone 20, solids would be directed to a disposal and or treatment. The fluid component 14 would flow to a decanting centrifuge 17, with the fluid component flowing to the rig pumps 19, and the fine solids flowing to, for example, a cuttings dryer 21 and then to disposal. The solids 11 retrieved from separation zone 20 may be disposed of directly into the environment or for further treatment, if necessary, prior to disposal.

Figure 3:
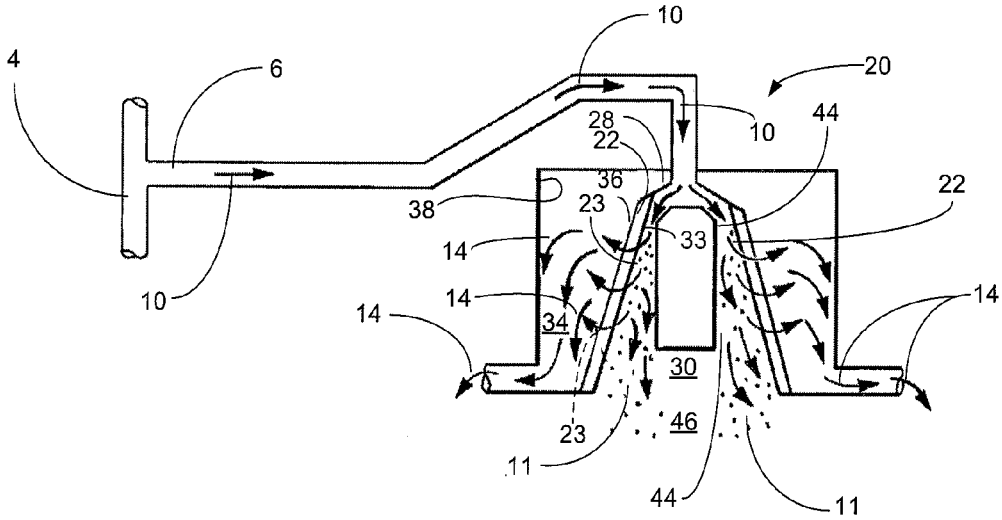
FIG. 3 illustrates a representational view of an apparatus for separating the solids from the fluids in the separation zone in undertaking the method of the present invention.
Figure 4:
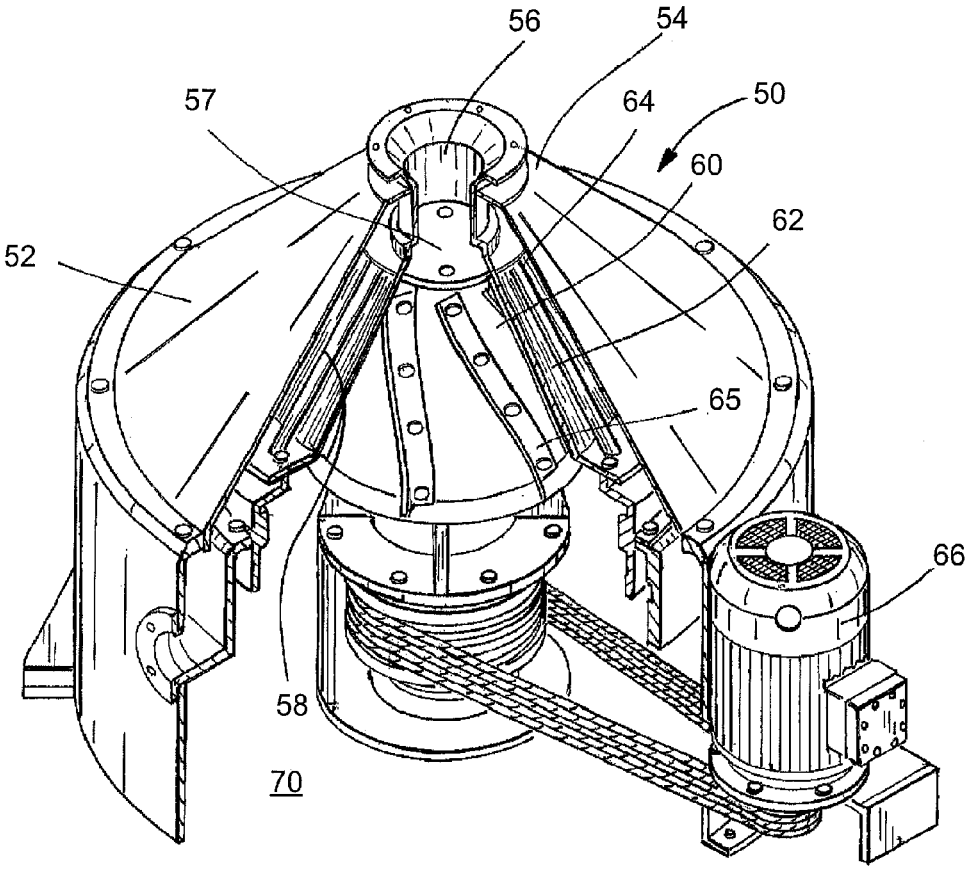
FIG. 4 illustrates a partial cutaway view of a device which could be utilized to undertake a part of the method of the present invention.
Figure 5:
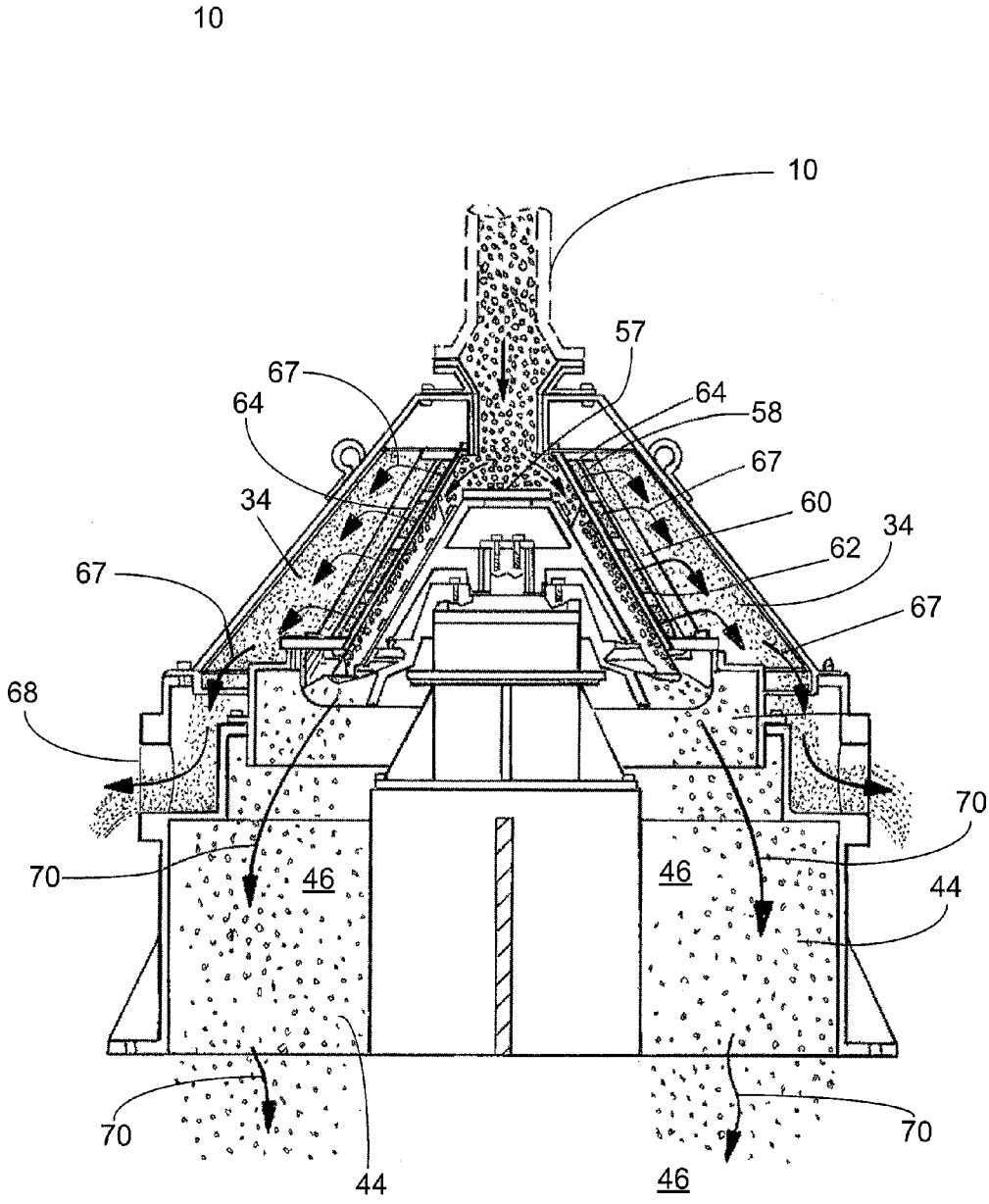
FIG. 5 illustrates a cross-section view of a device which could be utilized to undertake a part of the method of the present invention.
Figure 6:
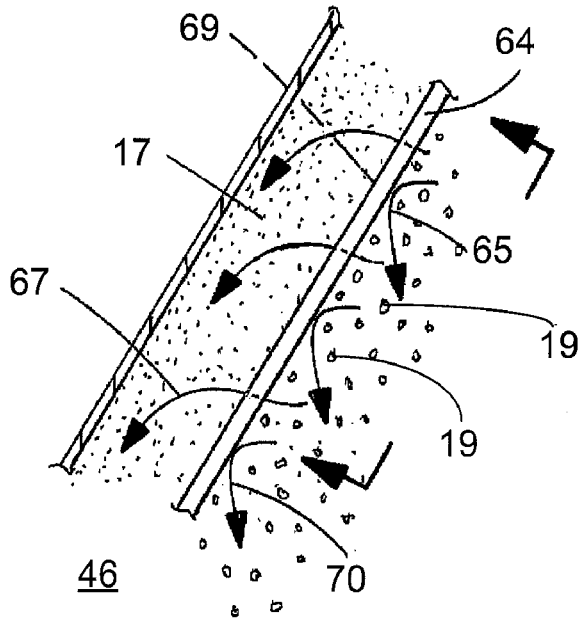
FIG. 6 illustrates a partial view of the fluid/solids mixture encountering the separation screen utilized in the device in FIG. 3.
Figure 7:
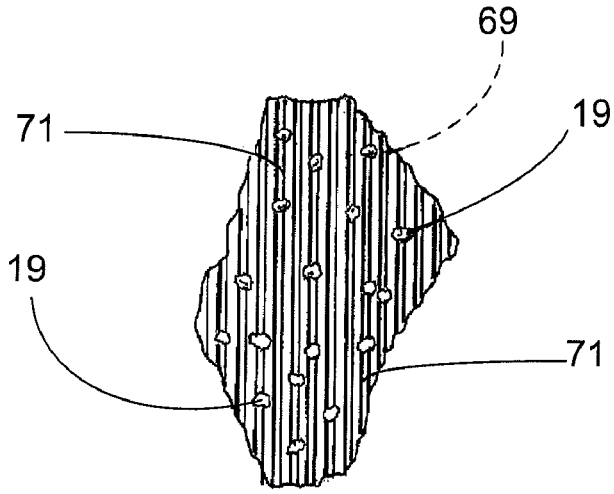
FIG. 7 illustrates a partial view of the longitudinal openings in the separation screen.
Figure 8:
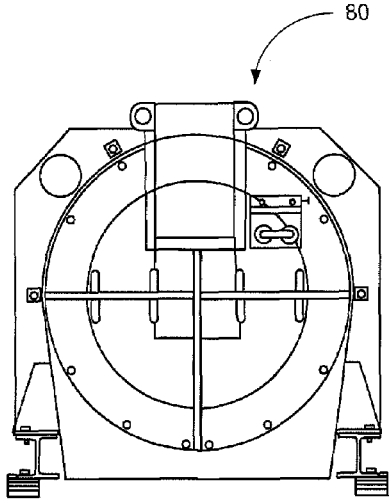
FIGS. 8 through 11 illustrate front, side, and rear views of a horizontal vibratory centrifuge utilized in the method of the present invention.
Figure 10:
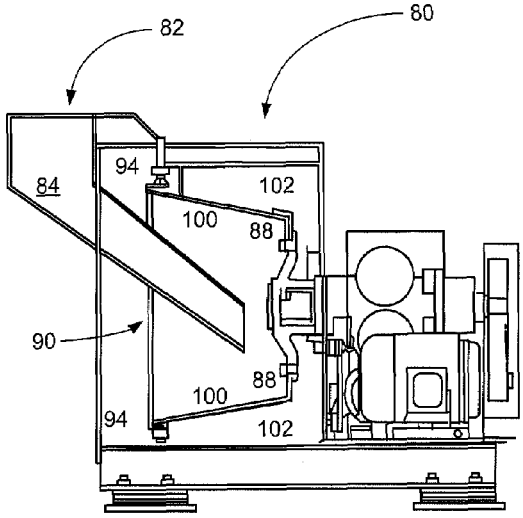
Figure 11:
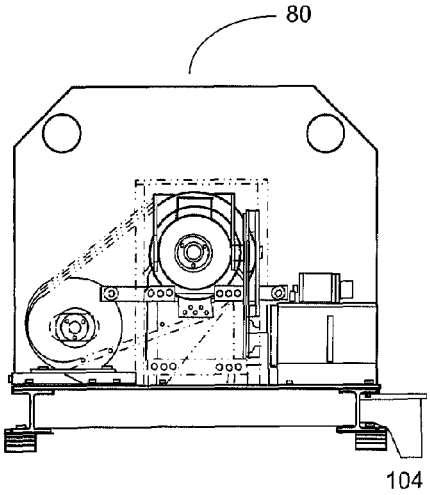
Figure 9:
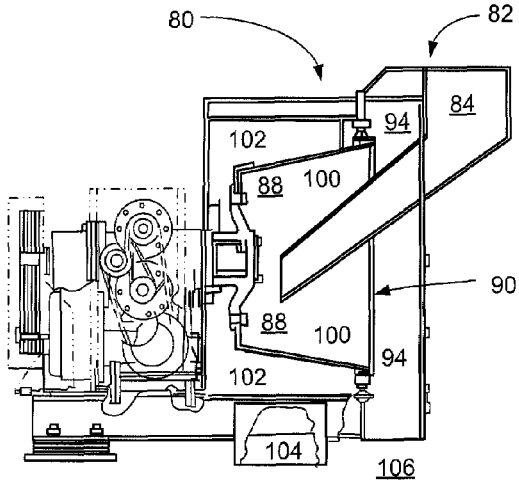

FIG. 3 represents an apparatus which may be used in the separation zone 20 to carry out the method of the present invention, while FIGS. 4 and 5 illustrate views of a device known in the art which could be utilized to undertake a portion of the method of the present invention, in its present or modified configuration.

As referred to earlier, in FIG. 3 there is depicted a representation of the improved process of the present invention for separating solid cuttings from fluids in a mixture at the surface during oil well drilling/production operations. The mixture 10 flowing up the borehole 4, upon reaching the surface, is routed into the flow line 6 of a certain diameter where the mixture 10 being returned up the well bore 4 will undergo fluid/solid separation. As seen upon entering the flow line 6, the mixture 10 is flowed directly into a first single separation zone 20 of a size capable of receiving the mixture 10. Such a zone may include a centrifuge of the type that will be described in FIGS. 4 and 5, but is certainly not limited to such a device. It is important that, unlike the prior art method, where the mixture 10 has undergone numerous steps before centrifuging the fluid medium at the end of the process, in the method of the present invention, the separation zone 20 must have the ability to receive the mixture flow 10 directly from the flow line 6 without having undergone any of the steps of being treated by the shale shakers, d-sanders, d-silters or the like devices, as seen in FIGS. 1A and 1B, which render the fluid flow virtually free of solids when (and if) the fluid flow needs to be centrifuged.

Turning now to FIGS. 3 through 11, reference is made first to FIG. 3. Upon entering the separation zone 20, the mixture 10 is circulated within the zone 20 to a desired RPM within the separation zone. The collection zone 20 provides a permeable barrier 22, which may be a screen or other permeable structure, having specified openings 23 in the barrier 22. The barrier is provided in such a manner that upon circulating the mixture 10 within the separation zone 20, the centrifugal force created by the intense circulation results in the mixture being forced against an interior surface 33 of the barrier 22 within the zone 20. Preferably, the barrier, as it is formed in a conical configuration, but not limited to; with a larger base 26 and a restricted cone top, but not limited to 28 for receiving the mixture 10 within the interior 30 of the barrier 22. Upon reaching the desired RPM's, the fluid portion 14 of the mixture 10 will flow through the openings 23 in the barrier 22, and be retrieved within a first retrieval zone 34 between the outer surface 36 of the barrier 22 and an exterior wall 38 of the retrieval zone 34. The fluids 14, as collected in this manner, will flow, via gravity, to the bottom 40 of the retrieval zone 34 to be collected through a passage 42, and returned to the well bore 4. It is foreseen that there will be no further need to treat the fluids 14 following the treatment received as described above, unless lower moisture contents are desired. Next, the solids 11, which are unable to penetrate the barrier 22, would be maintained within the barrier interior space 30, and again, like the fluids 14, through gravity would fall to a second retrieval zone 46, below the separation zone 20 and pass directly into the environment, or if laden with environmentally questionable materials, be passed to a cuttings dryer 29 or the like for drying, before disposal is undertaken.

It should be emphasized that in carrying out the method of the present invention, the cuttings laden fluid mixture is being treated and separated at a single separation zone, which eliminates the various devices as described in the prior art. Also, because of the solids in the mixture when it reaches the separation zone, not having had the benefit of the shakers or d-silters and d-sanders, is very much heavier and of greater quantity than the prior art. Therefore the separation zone must have the capability and efficiency to accommodate the flow of a great quantity of mixture and separating it sufficiently at that single zone to eliminate the steps described in the prior art.

FIGS. 4 and 5 represent a partial view and a cross section of a device, which is known in the art, which may be one option in carrying out the separation of the mixture into solids and liquid components in the separation zone of the method of the present invention. Although there may be other systems or devices which are capable of such separation, this device, if enlarged to a degree to accommodate the mixture flow, may suffice. Such a device, known as a centrifugal dryer, is known in the art also as a continuous centrifuge. As illustrated, the device 50 includes an outer wall 52 and a conical top portion 54. The device 50 would receive the mixture 10 through an upper feed opening or charging hopper 56, where the mixture would a encounter a cone cap 57 and be diverted into a conical separation area 58. This area would include an interior wall 60 and a screen basket 62 supporting a screen 64. The cone area, defined by the wall 60 would be circulated via a motor 66 to RPM's necessary to force the mixture 10 outward due to centrifugal force against the screen 64.

As illustrated in FIGS. 4-5-6 and 7, the openings 69 in the screen 64 would allow the fluid 14 to flow through the screen to a first retrieval zone 34 beyond the screen and flow in the direction of arrows 67 downward and through the liquid effluent discharge pipe 68 and be returned down the well bore 12. The solids 11, unable to penetrate the permeations 69 in the screen 64 would be swept downward, along flights 65, on screen 64, into the second retrieval zone 46, where in the direction of arrows 70, the solids 11 would be collected to be returned to the environment or for further treatment to remove unwanted environmentally hazardous components.

In carrying out the improved method for centrifugal separation of drilling fluids from solids via vertical or horizontal mechanical disposition or the like, the basic feedstock or mixture 10 to the apparatus is the returning drilling fluid from its circulation to the well bore. The drilling fluid is laden with drilled solids and other possible particulates detrimental to the active mud system. As seen in FIG. 5, this returning drilling fluid from the well bore is utilized as feed stock to the apparatus and will be introduced to the apparatus charging hopper 56 in preparation for treatment. Once delivered internally to the apparatus, it will immediately be set into a centrifugal motion due to the cause and effect of the internal spinning motion of the apparatus' conical screen 64. Once the initial impact of the feedstock (mixture) 10 matches the speed of the cone cap 57, the inherent subsequent feedstock plus centrifugal force guides it to the apparatus upper inner screen surface. The feedstock 10 then is immediately accelerated to approach a predetermined speed, at this point of contact.

At this staging moment, the drilled solids 11 contained in the drilling fluid feedstock 10 are forced downward along the inner vanes 71 of the screen 64 due to the widening portions of the conical screen itself, aided by the drilled solids own specific gravity. The drilling fluid (liquid phase) 14 is conversely accepted through the longitudinal apertures 69 between the screen vanes 71.

As the feedstock 10 is processed through the apparatus' internal devices, it will encounter series of preset flights 65 that are installed to the unit's cone. These flights 65 are designed to decelerate the feed stock 10 progress as to increase its residency within the apparatus so that operational efficiency can be improved allowing for a dryer under flow that is to be released to the atmosphere. This increased residency is obtained primarily by utilizing a differential speed of the flights which is less than the screen basket.

The separated solids 11 from the fluid phase 14 (underflow) exits the apparatus through a discharge port 70 located at the bottom of the unit. These solids 11 (refuse) can be discharged for further treatment or final disposition as regulated by environmental compliance to the drilling application. The fluid phase 14 of the drilling fluid is recaptured through the effluent trough for reuse in the active drilling fluids application.

It is foreseen that as part of the method of the present invention, that the solids may be separated from the liquids with the use of a horizontal centrifuge of the type illustrated in FIGS. 8 through 11. As illustrated, in horizontal centrifuge 80, a slurry of solids and liquids 81 continuously enters the top 82 of the centrifuge 80 through a feed hopper or chute 84, which evenly distributes the slurry 81 at the bottom 88 of the rotating conical screen 90. The feed slurry 81 is accelerated to peripheral speed of the screen 90 by frictional force. After acceleration, the solids 92 are transported to the large end 94 of the screen 90 by a continuous axial vibratory action. As the solid material 92 moves to the large end 94 of the screen 90, centrifugal force removes liquids 98 through the screen 90, while solids 92 are retained on the inside surface 100 of the screen 90. Liquids 98 are gathered in the launder area 102 and discharged through the effluent opening 104. Solids 92 flow out of the large end 94 of the screen 90 and fall through the opening 106 in the bottom of the centrifuge 80. The flow into the separation zone may be adjustable to a rate necessary to achieve the degree of separation that is essential during the operation; while the permeable barrier is a screen with openings of a size within the range as dictated by the lithology and rheology during the drilling operation. Also, the mixture is circulated at a range and necessary RPM's in order to achieve separation to a suitable degree. The separation zone would include either a vertical or horizontal centrifugal separation apparatus.

It is foreseen that if such a device, whether it be a horizontal or vertical centrifuge or separator, as described above, and known in the art is utilized in the method of the present invention, it would need to be enlarged to accommodate the volume of mixture introduced into the device through the feed opening, and would have to undergo modifications so that it could, through this single separation process, adequately separate the solids from the liquids in the mixture to satisfy both industry and environmental requirements.

PARTS LIST

The following is a list of suitable parts and materials for the various elements of the preferred embodiment of the present invention.

| | |
|---|---|
| well bore | 4 |
| production pipe | 5 |
| flow line | 6 |
| gumbo buster | 7 |
| scalping shaker | 8 |
| primary shaker | 9 |
| mixture | 10 |
| solids | 11 |
| arrows | 12 |
| d-sander and/or d-silter | 13 |
| fluid component | 14 |
| centrifuge | 15 |
| cuttings collection area | 16 |
| decanter | 17 |
| rig suction tank | 18 |
| rig pumps | 19 |
| separation zone | 20 |
| cuttings dryer | 21 |
| permeable barrier | 22 |
| openings | 23 |
| vertical/horizontal centrifugal separator | 24 |
| base | 26 |
| arrow | 27 |
| cone top | 28 |
| cuttings dryer | 29 |
| interior | 30 |
| interior surface | 33 |
| first retrieval zone | 34 |
| outer surface | 36 |
| exterior wall | 38 |
| bottom | 40 |
| passage | 42 |
| solids | 44 |
| second retrieval zone | 46 |
| device | 50 |
| outer wall | 52 |
| conical top portion | 54 |
| feed opening | 56 |
| cone cap | 57 |
| conical separation area | 58 |
| interior wall | 60 |
| screen basket | 62 |
| screen | 64 |
| flights | 65 |
| motor | 66 |
| arrows | 67 |
| discharge pipe | 68 |
| openings | 69 |
| arrows | 70 |
| inner vanes | 71 |
| horizontal centrifuge | 80 |

-continued

| | |
|---|---|
| top | 82 |
| slurry | 81 |
| chute | 84 |
| bottom | 88 |
| conical screen | 90 |
| solids | 92 |
| large end | 94 |
| liquids | 98 |
| inside surface | 100 |
| launder area | 102 |
| effluent opening | 104 |
| opening | 106 |

The foregoing embodiments are presented by way of example only; the scope of the present invention is to be limited only by the following claims.

The invention claimed is:

1. A method of separating drilling/production fluids from drilled cuttings from a mixture received from down hole, the method comprising the following steps:

a. flowing the mixture into a flow line above the surface of a well;

b. flowing the mixture directly into a single separation zone at a variable or constant rate dependent on the rig operational capacity and rate of penetration, but at least 300 gallons per minute; the separation zone being of a size capable of receiving the mixture directly from the flow line;

c. circulating the mixture within the separation zone, at a rate necessary to achieve desired separation between the liquid and solid components of the mixture to a suitable degree, but not less than 500 RPMs;

d. providing a permeable barrier surrounding the mixture as the mixture is circulating within the separation zone, the permeable barrier comprising a screen with openings of a size dictated by lythology and rheology of the drilled earthen matter, but no larger than 50 microns in diameter;

e. during circulation of the mixture, collecting the fluids in a first retrieval zone beyond the permeable barrier; and f. during circulation of the mixture, collecting the solids in a second retrieval zone within the permeable barrier.

2. The method in claim 1, wherein the permeable barrier comprises a screen having permeations sufficiently sized to allow liquid to pass but blocking the flow of most solid particles there through.

3. The method in claim 1, wherein the fluids are directed from the well bore after being collected in the first retrieval zone.

4. The method in claim 1, wherein those solids which meet environmental standards that are deemed safe for disposal after collection in the second retrieval zone.

5. The method in claim 1, wherein those solids which are not environmentally safe are further treated to remove environmentally unsafe components before disposal.

6. The method in claim 1, wherein the separation zone would comprise either a horizontal or vertical centrifugal separation apparatus.

7. A method of separating drilling/production fluids from solid cuttings from a mixture received from down hole, the method comprising the following steps:

a. flowing the mixture from the well bore into a flow line above the surface of a well;

b. flowing the mixture directly from the flow line into a single separation zone of a size capable of receiving the mixture flowing at a rate of at least 300 gallons per minute, at a continuous or variable rate;

c. centrifuging the mixture to at least 500 RPMs within the separation zone;

d. providing a liquid permeable barrier with openings of smaller than 80 micros surrounding the mixture as the mixture is centrifuged within the separation zone;

e. during centrifuging of the mixture, collecting the liquid in a first retrieval zone after the liquid has penetrated permeable barrier; and f. during centrifuging of the mixture, collecting the solids that could not penetrate the permeable barrier in a second retrieval zone within the barrier.

8. The method in claim 7, further comprising the step of disposing of those solids which meet environmental standards after collection in the second retrieval zone.

9. The method in claim 7, further comprising the step of treating those solids which are not environmentally safe to remove environmentally unsafe components before disposal.

10. The method in claim 7, wherein the permeable barrier comprises a screen with openings of a size dictated by lythology and rheology of the drilled earthen matter.

11. The method in claim 7, wherein the mixture is circulated at a rate of a range necessary to achieve desired separation of the liquid from the solids to a suitable degree.

12. The method in claim 7, wherein the mixture would be centrifuged with either a horizontal or vertical centrifuge separation apparatus.

13. A method of separating drilling/production fluids from solid cuttings from a mixture received from down hole, the method comprising the following steps:

a. flowing the mixture from the well bore into a flow line above the surface of a well;

b. flowing the mixture into a single separation zone of a size capable of receiving the mixture flowing at a rate of greater than 500 gallons per minute directly from the flow line on a continuous basis;

c. centrifuging the mixture to a desired RPM within the separation zone at a desired rate of at least 600 RPM's per minute;

d. providing a liquid permeable barrier having openings of less than 80 microns in size surrounding the mixture as the mixture is centrifuged within the separation zone so that when the mixture encounters the barrier, liquid may pass through the openings, but solids may not;

e. during centrifuging, collecting the liquid in a first retrieval zone after the liquid has penetrated the permeable barrier;

f. during centrifuging, collecting the solids that could not penetrate the permeable barrier in a second retrieval zone within the barrier interior;

g. disposing of those solids which meet environmental standards after collection in the second retrieval zone; and h. treating those solids which are not environmentally safe to remove environmentally unsafe components before disposal.

14. The method in claim 13, wherein the separation zone comprises a vertical centrifuge apparatus.

15. The method in claim 13, wherein the separation zone comprises a horizontal centrifuge apparatus.

* * * * *